US010398168B2

(12) United States Patent
Maiwald et al.

(10) Patent No.: US 10,398,168 B2
(45) Date of Patent: Sep. 3, 2019

(54) METHOD FOR MANUFACTURING A FIRST SUBUNIT OF AN HNB SMOKING ARTICLE, COMPRISING A ROD MEMBER AND A CAVITY THEREON, SUBUNIT, AND HNB SMOKING ARTICLE

(71) Applicant: HAUNI MASCHINENBAU GMBH, Hamburg (DE)

(72) Inventors: Berthold Maiwald, Schwarzenbek (DE); Hans-Heinrich Mueller, Oststeinbek (DE); Marc Kessler, Hamburg (DE)

(73) Assignee: HAUNI MASCHINENBAU GMBH, Hamburg (DE)

( * ) Notice: Subject to any disclaimer, the term of this patent is extended or adjusted under 35 U.S.C. 154(b) by 17 days.

(21) Appl. No.: 15/563,893

(22) PCT Filed: Feb. 29, 2016

(86) PCT No.: PCT/EP2016/054196
§ 371 (c)(1),
(2) Date: Oct. 2, 2017

(87) PCT Pub. No.: WO2016/155958
PCT Pub. Date: Oct. 6, 2016

(65) Prior Publication Data

US 2018/0116280 A1 May 3, 2018

(30) Foreign Application Priority Data

Mar. 31, 2015 (DE) ..... 10 2015 205 768

(51) Int. Cl.
*A24C 5/32* (2006.01)
*A24F 47/00* (2006.01)

(52) U.S. Cl.
CPC ..... *A24F 47/006* (2013.01)

(58) Field of Classification Search
CPC .... A24C 1/00; A24C 3/00; A24C 5/00; A24F 1/02; A24F 1/16; A24F 1/22;
(Continued)

(56) References Cited

U.S. PATENT DOCUMENTS 5,469,871 A * 11/1995 Barnes ..... A24C 5/471 131/194
7,004,896 B2 2/2006 Heitmann et al.
(Continued)

FOREIGN PATENT DOCUMENTS

CA 2 918 188 2/2015
DE 101 05 010 9/2002
(Continued)

OTHER PUBLICATIONS

Examination Report from German Patent Office for Application No. 10 2015 205 768.2, dated Jan. 7, 2016, pp. 1-5.
(Continued)

*Primary Examiner* — Hae Moon Hyeon
(74) *Attorney, Agent, or Firm* — Saliwanchik, Lloyd & Eisenschenk

(57) ABSTRACT

The present invention relates to a method for producing a first subunit of an HNB smoking article that comprises a rod-shaped body and a cavity arranged thereon, wherein a tubular body is arranged on and attached to one of the end faces of the rod-shaped body, such as via a cover strip attaching the tubular body to the rod-shaped body.

20 Claims, 2 Drawing Sheets

(58) Field of Classification Search
CPC .... A24F 47/002; A24F 47/006; A24F 47/008; A24D 1/00; A24D 1/042
USPC ..... 131/280, 194, 361
See application file for complete search history.

(56) References Cited

U.S. PATENT DOCUMENTS

| | | | | |
|---|---|---|---|---|
| 10,039,313 | B2 * | 8/2018 | Mironov | A24D 3/0287 |
| 2004/0173229 | A1 | 9/2004 | Crooks et al. | |
| 2008/0029111 | A1 * | 2/2008 | Dube | A24C 5/471 131/280 |
| 2009/0065011 | A1 * | 3/2009 | Maeder | A24F 47/006 131/194 |
| 2011/0041861 | A1 | 2/2011 | Sebastian et al. | |
| 2012/0067360 | A1 * | 3/2012 | Conner | A24B 15/165 131/280 |
| 2013/0146075 | A1 * | 6/2013 | Poget | A24B 15/165 131/329 |
| 2013/0206152 | A1 * | 8/2013 | Garcia Urbano | A24D 1/045 131/281 |
| 2013/0239980 | A1 * | 9/2013 | Kaljura | A24C 5/471 131/94 |
| 2015/0122273 | A1 * | 5/2015 | Mironov | A24D 3/0287 131/328 |
| 2015/0157052 | A1 * | 6/2015 | Ademe | A24C 5/10 131/58 |

FOREIGN PATENT DOCUMENTS

| | | |
|---|---|---|
| EP | 2 777 408 | 9/2014 |
| EP | 2 814 342 | 12/2014 |
| WO | WO 2013/120565 | 8/2013 |
| WO | WO 2016/088064 A1 | 6/2016 |

OTHER PUBLICATIONS

International Search Report for Application No. PCT/EP2016/054196, dated May 19, 2016, pp. 1-6.
Office Action dated Sep. 21, 2018 issued by the European Patent Office with respect to the parallel European Patent Application No. 16 707 098.6.

* cited by examiner

METHOD FOR MANUFACTURING A FIRST SUBUNIT OF AN HNB SMOKING ARTICLE, COMPRISING A ROD MEMBER AND A CAVITY THEREON, SUBUNIT, AND HNB SMOKING ARTICLE

CROSS-REFERENCE TO RELATED APPLICATIONS

The present application is the U.S. National Stage Application of International Patent Application No. PCT/EP2016/054196, filed on Feb. 29, 2016, which claims priority to German Patent Application No. 10 2015 205 768.2, filed on Mar. 31, 2015, both of which are hereby incorporated by reference herein in their entirety, including any figures, tables, or drawings.

FIELD OF THE INVENTION

The present invention relates to a method for producing a first subunit of an HNB smoking article that comprises a rod-shaped body and a cavity arranged thereon, which method has the features of the preamble of claim 1, to a subunit having the features of the preamble of claim 12, and to an HNB smoking article according to claim 19.

BACKGROUND OF THE INVENTION

The principle for releasing volatile tobacco components on which HNB smoking articles are based is fundamentally different to that behind conventional smoking articles, in which the components are released by burning the tobacco. In what are referred to as HNB (heat not burn) smoking articles, the tobacco components are instead released by hot gases passing through the tobacco and/or by heating the tobacco, and therefore the amounts of the smoke components that were previously inevitably released when burning the tobacco are at least significantly reduced, or said components can even be eliminated completely. For this purpose, a heat source is provided in the HNB smoking article that is arranged on the end of the HNB smoking article that is remote from the mouth piece, i.e. upstream of the tobacco in the drag direction, and therefore the gases heated by the heat source flow through the tobacco and heat the tobacco, and the volatile components are removed from the tobacco in the process. The tobacco can also be heated directly by the heat source.

HNB smoking articles are composed of a plurality of subunits or also segments that are held together by one or more cover strips. In addition to the above-described segments, namely the heat source and the tobacco segment, a cavity is provided between the heat source and the tobacco segment, which cavity is filled with a flavouring agent or catalyst in the form of loose pellets or fibres. The hot gases generated by the heat source then flow through the flavouring agent or catalyst before flowing through the tobacco, and therefore the hot gases flowing from the heat source can be positively influenced such that they have an improved taste or such that the number of components that are harmful to health is reduced. Furthermore, in order to outgas the components from the tobacco, comparatively high temperatures have to be brought about by the gases heated by the heat source or by directly heating the tobacco, and therefore a cooling portion can also be provided downstream of the tobacco, in which cooling portion the gases leaving the tobacco are subsequently cooled so that the consumer does not burn his mouth when smoking.

HNB smoking articles of this type are known, in principle, from US 2011/0041861 A1, US 2004/0173229 A1 and EP 2 777 408 A1.

EP 2 777 408 A1 in particular discloses forming the cavity by wrapping a flexible cover strip around the heat source and sticking said cover strip, by a projecting axial length, to the rod-shaped heat source. For this purpose, the cover strip is provided with an L-shaped adhesive joint and is adhered to the rod-shaped heat source by one leg of the L-shaped adhesive joint, and the two free edges of the cover strip that come to overlap one another are adhered to one another by means of the other leg of the L-shaped adhesive joint such that the cover strip is cylindrical. The projecting axial length of the cover strip then forms a cylindrical cavity that opens into an end face of the first subunit.

This solution is disadvantageous in that, in a first step, the cover strip is adhered to the heat source by means of the L-shaped adhesive joint in a point by point manner, and therefore if the cover strip is pulled at an angle and is thus obliquely oriented, it is adhered to the heat source in a correspondingly crooked manner. Furthermore, the cover strip has to be correspondingly flexible in order for it to be possible to wrap it around the heat source; however, this has an adverse effect on a subsequent cutting process because, owing to the flexibility thereof, the cover strip has a tendency to become slack during the cutting process. Therefore, a significant amount of effort is required in order to produce a clean cut—that is if this is even possible. Furthermore, the cavity formed by the projecting axial length of the cover strip is subsequently filled with pellets or fibres of a flavour carrier or a catalyst, for which purpose the heat source together with the adjoining cavity formed by the cover strip has to be oriented vertically, there being a cavity that is open at the top, in order for it to be possible to fill the cavity with the pellets or fibres from above in a manner which is beneficial in terms of process. However, this filling process can be made more difficult in undesirable conditions if the flexible cover strip is deformed by kinking, for example, and the cavity thus cannot be accessed from the top in a completely free manner.

BRIEF SUMMARY OF THE INVENTION

Against this background, the object of the invention is to provide a method for producing a first subunit of an HNB smoking article that comprises a rod-shaped body and a cavity arranged thereon, which method is improved in terms of process reliability and quality.

In order to achieve this object, a method having the method steps of claim 1, a subunit having the features of claim 12 and an HNB smoking article having the features of claim 19 is proposed. Further preferred developments of the method can be found in the dependent claims, the drawings and the associated description.

According to the basic concepts of the invention, it is proposed that a tubular body is arranged on and attached to one of the end faces of the rod-shaped body. The proposed solution is advantageous in that, owing to the proposed use of the tubular body, the cavity adjoining the rod-shaped body is formed by a shaped part which already comprises the cavity. As a result, the cavity is not produced only by attaching the flexible cover strip and sticking the edges of the cover strip together, as is known in the prior art, but rather, in this case, the cavity is already part of the tubular body and, by attaching the tubular body to the rod-shaped body, said cavity is conveniently placed on the rod-shaped body in its finished form. The cavity, in this form, can thus be arranged on and attached to the rod-shaped body in a qualitatively significantly improved manner and by means of a significantly more reliable process than was possible using the known production method. In this case, the shape and size of the cavity can be determined precisely by the dimensioning of the cavity in the tubular body arranged on and attached to the rod-shaped body. In this case, the tubular body is a dimensionally stable body having a cavity which is intrinsically rigid to the extent that the geometry remains at least approximately constant under the effect of transverse forces that occur during the production process. In this case, the tubular body can also have a cross-sectional geometry that is adapted to the cross-sectional shape of the rod-shaped body, and therefore, after the rod-shaped body and the tubular body have been fitted together, a first subunit is produced that has a uniform, continuous outer geometry. In this case, the tubular body can be designed, in terms of wall thickness and by accordingly selecting the material thereof, such that it can be connected to the rod-shaped body in a particularly simple manner and can be subsequently cut by means of a reliable process. Furthermore, the rigidity of the tubular body is selected such that, in any case, the cavity remains open at the top, even under the effect of lateral process forces, and therefore said cavity can be filled from above by means of a reliable process. In this case, the tubular bodies can be cut, in an earlier work step, to a predetermined length from a prefabricated tube, which can be purchased by the meter as a prefabricated bought-in part for a low price.

A particularly simple type of attachment can be achieved by the tubular body being attached to the rod-shaped body by means of a first cover strip that is adhered to the rod-shaped body and to the tubular body. In this case, the cover strip covers both a portion of the rod-shaped body and a portion of the tubular body and is adhered thereto by the overlapping surfaces. In this case, the cover strip can be adhered to the rod-shaped body and to the tubular body after an adhesive has been applied thereto by means of an established rolling process.

It is also proposed that the first cover strip is adhered to the tubular body and to the rod-shaped body over the entire surface thereof. The entire surface of said cover strip being adhered to the two bodies means that it is possible to provide a very secure connection, while at the same time ensuring that the first cover strip is positioned relative to the rod-shaped body and the tubular body in a highly accurate manner.

If the rod-shaped body is a heat source, the first cover strip is preferably only adhered to at most 30%, preferably between 20% and 30%, of the lateral surface area of the heat source. This means that an area of the heat source that is required in order for it to fulfil its function is exposed to the surroundings, the cover strip being adhered to 20% to 30% of the lateral surface area still being sufficient for ensuring that the cover strip and the tubular body held thereby are securely attached to one another.

It is also proposed that the tubular body is coated on the inside with a metal and/or organic coating before being attached to the rod-shaped body. The proposed coatings are used to prevent gases or liquids from passing through the tubular body. Since gases or liquids are supposed to be prevented from passing through the tubular body even at high temperatures, it is also proposed that the coating is stable at temperatures of up to at least 350 degree Celsius.

The method can be further improved in terms of an increased production capacity by a double-length tubular body being arranged between two rod-shaped bodies, being connected thereto and being subsequently cut down the centre. As a result, two first subunits, each consisting of a rod-shaped body and a tubular body, can be produced in a single connection step followed by a cutting process.

In this case, the tubular body can be connected to the two rod-shaped bodies in a particularly simple manner by the double-length tubular body being connected to the two rod-shaped bodies by means of a double-width cover strip in a single work step and before being cut. In a single rolling process, the double-width cover strip, which is wetted with adhesive, is rolled around the double-length tubular body and an annular contact surface of each rod-shaped body, and is thus connected thereto.

In this case, the method can be further simplified by the double-length tubular body having a horizontally oriented longitudinal axis being cut, and the two first subunits formed thereby, each consisting of a rod-shaped body together with a tubular body held thereon, being subsequently rotated into a vertical orientation in which the cavity in the tubular body is open at the top. The horizontally oriented double-length tubular body is located coaxially between the two rod-shaped bodies, i.e. the double-length tubular body is inserted between the rod-shaped bodies in the horizontal orientation, or the rod-shaped bodies are positioned coaxially on the outside of the horizontally oriented double-length tubular body, and this is very easy to implement in terms of process. After the double-length tubular body has been attached to the two rod-shaped bodies arranged on the end faces, the double-length tubular body is then cut down the centre, for example by being guided past a blade of a stationary knife in an established conveying process that uses drums.

It is also proposed that the rod-shaped body and the tubular body having horizontally oriented longitudinal axes are interconnected to form the first subunit, and the first subunit is then rotated until the longitudinal axis of the rod-shaped body and the longitudinal axis of the tubular body are vertically oriented and the tubular body of which the cavity is open at the top is arranged above the rod-shaped body, and the cavity is then filled with a filling material from above.

Owing to the proposed development, the filling material, which is in this case the pellets or fibres of the filler material, can be poured into the cavities in a particularly simple manner, the dimensional stability of the tubular bodies ensuring that the cavities can be readily accessed from the top. Furthermore, the filling process can be further improved owing to the dimensional stability of the tubular body, since the tubular body forms a dimensionally stable cavity for receiving the filling material, which cavity keeps its shape even when transverse forces are exerted thereon. As a result, the filling material can be poured in at a particular pressure, e.g. also in an automated manner. Furthermore, the cavity is not compressed even when the tubular body is moved laterally in order to make contact with a counter surface of the production equipment.

It is particularly advantageous in terms of dimensional stability and cutting properties if the tubular body is made of cellulose. For this purpose, the tubular body can be made, for example, of a paperboard having a wall thickness of from 0.1 to 0.3 mm. In this case, the use of cellulose is also advantageous in terms of environmental sustainability and production costs because cellulose is a very inexpensive material that is, however, sufficient for the requirements that are imposed here.

BRIEF DESCRIPTION OF THE DRAWINGS

The invention is explained in the following on the basis of preferred embodiments with reference to the accompanying drawings, in which.

DETAILED DESCRIPTION OF THE INVENTION

Figure 1:
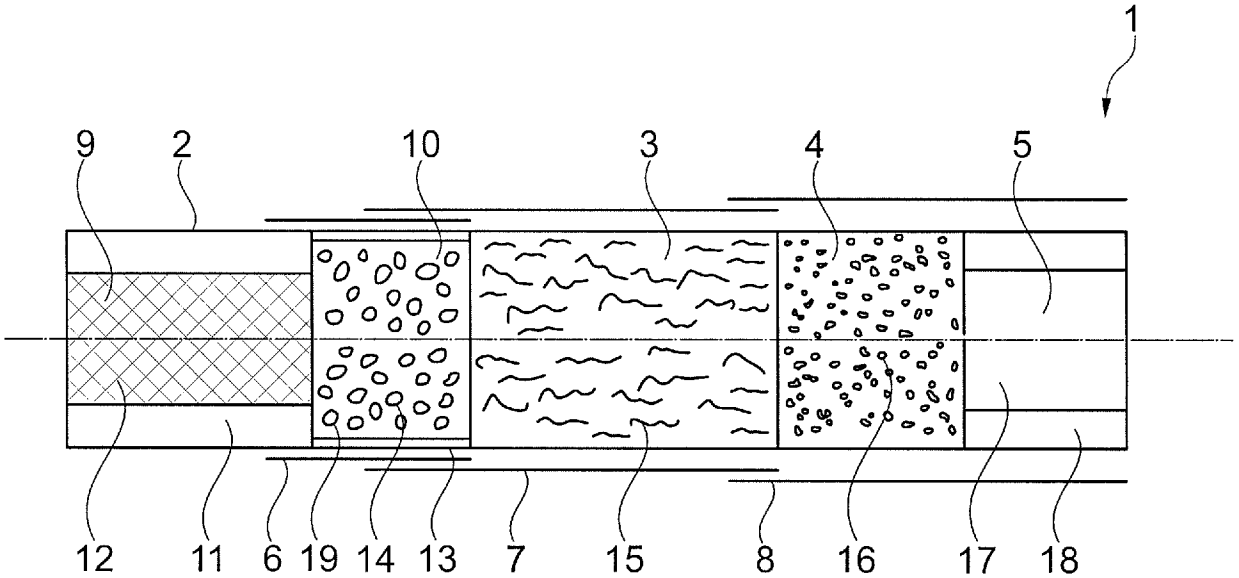
FIG. 1 shows an HNB smoking article comprising various subunits.

FIG. 1 shows an HNB (heat not burn) smoking article 1 in the form of a cigarette. The HNB smoking article 1 is composed of a plurality of subunits 2, 3, 4 and 5, or also segments, which are held together by three cover strips 6, 7 and 8. In this figure, the first subunit 2 is formed by a rod-shaped body 9 and an adjoining tubular body 10 which are interconnected by the first cover strip 6. The second subunit 3 is a tobacco stick filled with tobacco fibres 15, the third subunit 4 is a filter filled with a filter material 16 and, finally, the fourth subunit 5 is a mouth piece which is formed by a tubular piece 18 having a cavity 17. The second subunit 3 is connected to the first subunit 2 by the second cover strip 7, and the third subunit 4, together with the fourth subunit 5, is connected to the second subunit 3 by the third cover strip 8. As a whole, this results in a dimensionally stable, rod-shaped HNB smoking article 1 having a circular cross-sectional area.

The rod-shaped body 9 of the first subunit 2 is in this case formed by a heat source which has a heat-generating, combustible core 12, e.g. activated carbon, and an insulation layer 11. In addition to activated carbon, heat sources that are electrically activated in an alternative manner or heat sources that contain a combustible material that is not activated carbon can also be used as heat sources.

According to the invention, adjoining the rod-shaped body 9 is the tubular body 10 that is attached thereto, which tubular body comprises a cavity 14 and is formed by a thin tubular wall 13 that is made of cellulose and has a preferred wall thickness of from 0.1 to 0.3 mm. A quantity of loose cellulose-based pellets 19 is provided in the cavity 14 of the tubular body 10, which pellets are impregnated with propylene glycol and are used to influence flavour and/or to reduce the number of components in the hot gases that are generated by the heat source. The tubular body 10 is dimensionally stable to the extent that the shape of the cavity 14 does not change during the production process, even under the effect of transverse forces. Therefore, the cavity 14 adjoining the rod-shaped body 9 is conveniently prefixed by the tubular body 10 and, as a result of the connection between the tubular body 10 and the rod-shaped body 9, is placed on the rod-shaped body 9 in a convenient manner by means of the production method described below.

The consumer activates the HNB smoking article 1 by igniting the combustible core 12 of the heat source and, as is the case in conventional cigarettes, sucking on the mouth piece, which is in this case the fourth subunit 5. The air flow that is drawn in then flows from the heat source through the pellets 19 arranged in the cavity 14 of the tubular body 10 and then through the tobacco fibres 15 of the tobacco stick and, in the process, outgases the volatile components of the tobacco fibres 15. The hot gas flow in which these volatile components of the tobacco fibres 15 are concentrated then flows through the filter material 16 and the cavity 17 of the mouth piece, and is then inhaled by the consumer. In the process, the air flow is cooled down in the filter material 16 and in the stretch covered by the cavity 17. If cooling is insufficient, additional cooling regions, which may or may not comprise cooling material, can of course be provided.

The invention relates to the method for producing the first subunit 2 comprising the rod-shaped body 9, which is formed by the heat source, and the adjoining cavity 14, which method is described in more detail in the following with reference to FIG. 2.

In a first step, a double-length rod-shaped body 20 is provided and cut down the centre to form two individual rod-shaped bodies 9 of a single length. Subsequently, the two rod-shaped bodies 9 are pulled apart from one another and a double-length tubular body 21 is inserted between the rod-shaped bodies 9, as can be seen in the drawings at the top of FIG. 2. In earlier processing steps, the double-length tubular bodies 21 can be cut from tubular pieces of a length that is a multiple of the single length, subsequently staggered and lined up one behind the other by means of pressurised air to form a sequence of identically oriented double-length tubular bodies 21 that have longitudinal axes that are oriented in parallel with one another, the width of the strip corresponding to the length of the double-length tubular body 21. For this purpose, the double-length tubular bodies 21 are initially staggered after being cut and are then pushed together by means of pressurised air such that they have the same orientation and form the strip. The bodies can however also be pushed together mechanically by means of a counter surface. The bodies being pushed together by means of pressurised air is however advantageous in that the load on the double-length tubular bodies 21 is as low as possible, it also being possible in this case to move the double-length tubular bodies 21 on a type of air cushion in order to further reduce the load.

In a subsequent step, a double-width first cover strip 22 is provided, the entire surface of which is preferably wetted with an adhesive and which is wrapped, in a rolling process, around the double-length tubular body 21 and around approximately 20 to 30% of the adjoining annular lateral surfaces of the rod-shaped bodies 9, as a result of which the double-length tubular body 21 is connected to the two rod-shaped bodies 9 arranged on the end faces. In a subsequent step, the resulting assembly is cut by a central cut through the double-length tubular body 21 into two first subunits 2, each consisting of a rod-shaped body 9 and a single-length tubular body 10, which subunits are interconnected by a first cover strip 6 of a single width. The cut through the double-length tubular body 21 is made when the double-length tubular body 21 is horizontally oriented, and this is advantageous in that the rod-shaped bodies 9 and the double-length tubular body 21 are in this case transported on a lateral surface of a transportation drum having a horizontal axis of rotation, as a result of which it is possible to produce a cut that has a particularly high cut quality. Furthermore, the cut quality is improved by the cavity 14 for receiving the pellets 19 being formed by the dimensionally stable double-length tubular body 21, which is then attached to the rod-shaped body 9 by means of the double-width cover strip 22. Owing to the dimensional stability thereof, the dimensionally stable double-length tubular body 21 is resistant to the cutting knife to such an extent that it is not deformed during the cutting process. As a result, the cutting knife cuts through the double-length tubular body 21 with a clean and perpendicular cut of a high cut quality.

Figure 2:
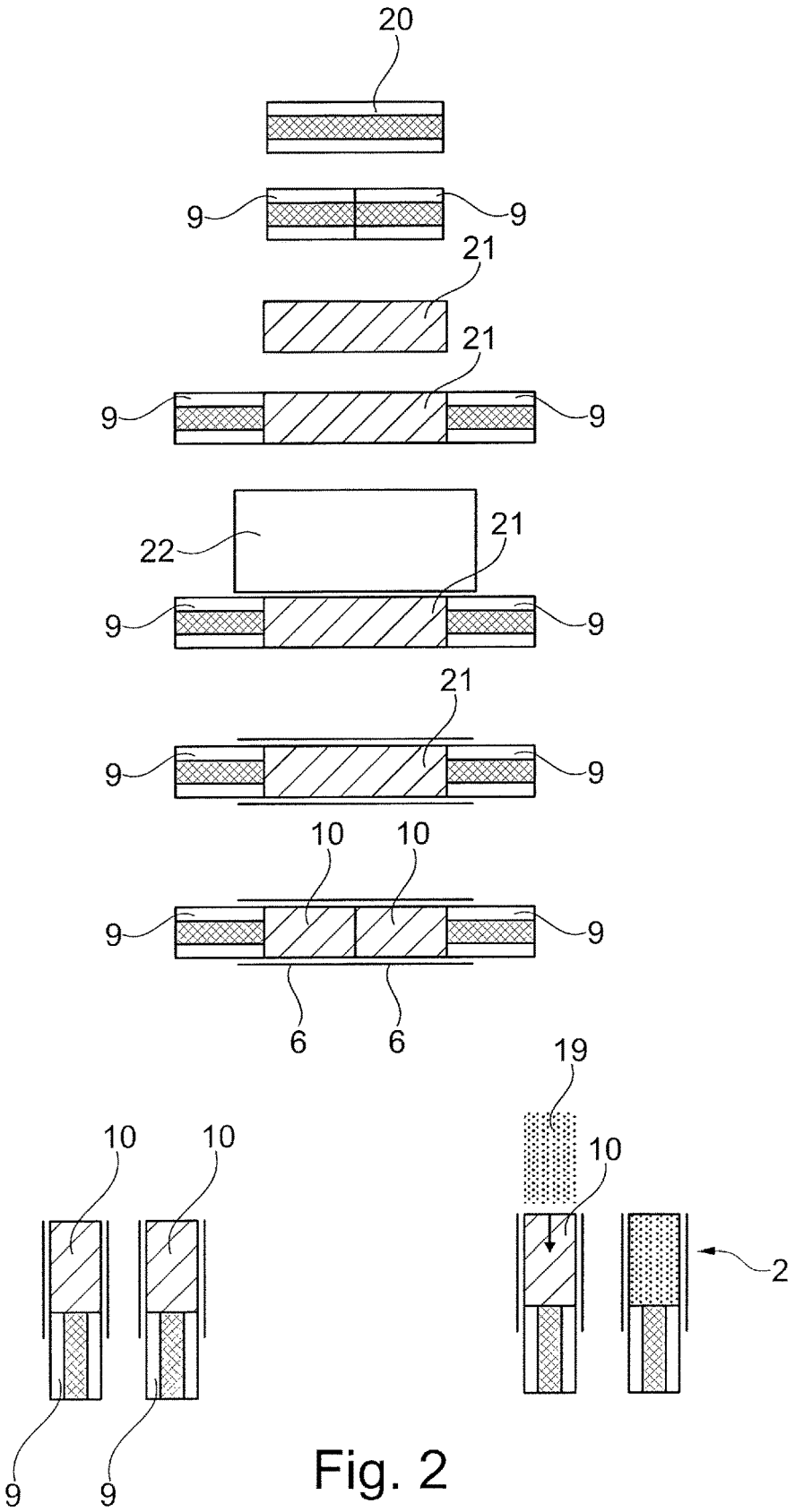
FIG. 2 shows a method sequence according to the invention for producing a subunit of the HNB smoking article that comprises a rod-shaped body and a tubular body.

In order to fill the cavities 14 of the two resulting tubular bodies 10 of a single length, the two first subunits 2 are rotated into an orientation in which the longitudinal axes thereof are vertically oriented and in which the two cavities 14 are open at the top, by the tubular bodies 10 being arranged above the rod-shaped bodies 9, as can be seen in the drawings at the bottom of FIG. 2.

Subsequently, the pellets 19 are poured into the cavities 14 from above, and this completes the method for producing the first subunits 2. In a subsequent step, the second subunit 3 in each case, which is the tobacco stick in this case, is set in position coaxially from above and connected to the first subunit 2 by the second cover strip 7. Subsequently, the third subunit 4 and the fourth subunit 5 are set in position one after the other, also coaxially, and connected to the second subunit 3 by the third cover strip 8.

The method for producing the first subunit 2 comprising the heat source has been described; however, it would also be possible to fasten the third subunit 4 to the fourth subunit 5 so as to form an assembly by means of the same production method, the cavity 17 in the mouth piece not being filled in this case.

Furthermore, the proposed method for producing the first subunit 2 is also advantageous for other subunits or segments of the HNB smoking article 1, if adjoining cavities have to be provided on said subunits or segments. Firstly, owing to the use of the proposed tubular bodies 10, the cavities are automatically dimensionally stabilised such that it is easier to fasten the subunits by means of the cover strips. In particular, by means of the tubular body 10, a dimensionally stable contact surface for adhering the cover strip is provided. Furthermore, the subunits are each assembled so as to have a vertically oriented longitudinal axis, and therefore, in this case, the tubular body 10 is also used as a spacer for the adjoining subunit that is to be set in position.

The invention is also considered to be advantageous in that the first subunit 2 can also be produced in a prefabrication process and stored intermediately. If active carbon is used as the heat source, it is expedient to cut the rod-shaped bodies 9 immediately after the string has been produced since, in this state, the active carbon can still be cut in an effective manner before it hardens by cooling. In this case, the first subunits 2 can be stored intermediately both before and after the double-length tubular body 21 has been cut.

The invention claimed is:

1. A method for producing a subunit of a Heat Not Burn (HNB) smoking article, comprising:

arranging a tubular body on an end face of a rod-shaped body; and attaching the tubular body to the rod-shaped body, wherein attaching the tubular body to the rod-shaped body comprises adhering a cover strip to the tubular body and to the rod-shaped body such that the cover strip attaches the tubular body to the rod-shaped body;

wherein arranging the tubular body on the end face of the rod-shaped body comprises arranging a double-length tubular body between the end face of the rod-shaped body and a corresponding additional end face of an additional rod-shaped body, wherein attaching the tubular body to the rod-shaped body comprises attaching the double-length tubular body to the rod-shaped body and to the additional rod-shaped body, and wherein, after attaching the double-length tubular body to the rod-shaped body and to the additional rod-shaped body, the method further comprises:

cutting the double-length tubular body down a center of the double-length tubular body;

wherein attaching the double-length tubular body to the rod-shaped body and to the additional rod-shaped body comprises attaching the double-length tubular body to the rod-shaped body and the additional rod-shaped body via a double-width cover strip;

wherein cutting the double-length tubular body down the center of the double-length tubular body comprises:

orienting a longitudinal axis of the double-length tubular body horizontally when cutting double-length tubular body down the center of the double-length tubular body; and cutting the double-length tubular body into two separate pieces and to produce two separate structures, wherein a first piece of the two separate pieces is the tubular body and a first structure of the two separate structures is the tubular body attached to the rod-shaped body, and wherein a second piece of the two separate pieces is an additional tubular body, and a second structure of the two separate structures is the additional tubular body attached to the additional rod-shaped body;

orienting the tubular body attached to the rod-shaped body such that a longitudinal axis of the tubular body and a longitudinal axis of the rod-shaped body are vertically oriented, and a cavity of the tubular body is open at a top of the tubular body, which is above the rod-shaped body; and filling the cavity of the tubular body with a filling material from above the tubular body.

2. The method according to claim 1, wherein the cover strip is adhered to the tubular body and to the rod-shaped body over the entire surface of the cover strip.

3. The method according to claim 1, wherein the rod-shaped body is a heat source, and wherein the cover strip is adhered to at most 30% of a lateral surface area of the heat source.

4. The method according to claim 1, wherein, prior to attaching the tubular body to the rod-shaped body, coating an inside of the tubular body with a metal and/or organic coating.

5. The method according to claim 4, wherein the metal and/or organic coating is stable at temperatures of up to at least 350 degrees Celsius.

6. The method according to claim 1, wherein the tubular body is made of cellulose.

7. A subunit of a Heat Not Burn (HNB) smoking article, comprising:

a rod-shaped body, wherein the rod-shaped body has a cavity arranged thereon; and a tubular body arranged on, and attached to, an end face of the rod-shaped body, wherein the cavity of the tubular body is filled with a filling material, wherein the subunit of the Heat Not Burn (HNB) smoking article is produced according to the method of claim 1.

8. The subunit according to claim 7, wherein the cover strip is adhered to the tubular body and to the rod-shaped body over an entire surface of the cover strip.

9. The subunit according to claim 7, wherein the rod-shaped body is a heat source, and the cover strip is adhered to at most 30% of a lateral surface area of the heat source.

10. The subunit according to claim 9, wherein the cover strip is adhered to 20% to 30% of the lateral surface area of the heat source.

11. The subunit according to claim 7, wherein the tubular body is coated on an inside of the tubular body with a metal and/or organic coating.

12. The subunit according to claim 11,
wherein the metal and/or organic coating is stable at temperatures of up to at least 350 degrees Celsius.

13. The subunit according to claim 7,
wherein the tubular body is made of cellulose.

14. A Heat Not Burn smoking article, comprising:
a subunit according claim to 7.

15. The heat not burn smoking article according to claim 14, wherein the cover strip is adhered to the tubular body and to the rod-shaped body over an entire surface of the cover strip.

16. The heat not burn smoking article according to claim 14, wherein the rod-shaped body is a heat source, and the cover strip is adhered to at most 30% of a lateral surface area of the heat source.

17. The heat not burn smoking article according to claim 16, wherein the cover strip is adhered to 20% to 30% of the lateral surface area of the heat source.

18. The heat not burn smoking article according to claim 14, wherein the tubular body is coated on an inside of the tubular body with a metal and/or organic coating.

19. The heat not burn smoking article according to claim 18, wherein the metal and/or organic coating is stable at temperatures of up to at least 350 degrees Celsius.

20. The heat not burn smoking article according to claim 14, wherein the tubular body is made of cellulose.

* * * * *